US011622584B2

(12) United States Patent
Zhang et al.

(10) Patent No.: US 11,622,584 B2
(45) Date of Patent: Apr. 11, 2023

(54) ELECTRONIC-CIGARETTE CARTRIDGE AND ELECTRONIC CIGARETTE

(71) Applicant: Shanghai Fudan Microelectronics Group Company Limited, Shanghai (CN)

(72) Inventors: Gang Zhang, Shanghai (CN); Yaohai Song, Shanghai (CN); Zhihua Shen, Shanghai (CN); Yixin Shi, Shanghai (CN); Yuan Peng, Shanghai (CN); Tingsong Luo, Shanghai (CN)

(73) Assignee: Shanghai Fudan Microelectronics Group Company Limited, Shanghai (CN)

( * ) Notice: Subject to any disclaimer, the term of this patent is extended or adjusted under 35 U.S.C. 154(b) by 294 days.

(21) Appl. No.: 17/026,774

(22) Filed: Sep. 21, 2020

(65) Prior Publication Data

US 2021/0386123 A1 Dec. 16, 2021

(30) Foreign Application Priority Data

Jun. 15, 2020 (CN) ..... 202010544696.X

(51) Int. Cl.
*A24F 40/53* (2020.01)
*A24F 40/42* (2020.01)

(52) U.S. Cl.
CPC ..... *A24F 40/53* (2020.01); *A24F 40/42* (2020.01)

(58) Field of Classification Search
CPC ..... A24F 40/53; A24F 40/42; A24F 40/10; A24F 40/40; A24F 40/46
See application file for complete search history.

(56) References Cited

U.S. PATENT DOCUMENTS

2017/0215478 A1 8/2017 Harrison et al.
2019/0158938 A1* 5/2019 Bowen ..... H04M 1/72415
(Continued)

FOREIGN PATENT DOCUMENTS

CA 3096955 A1 9/2019
CA 3102424 A1 12/2019
(Continued)

OTHER PUBLICATIONS

Office Action dated Feb. 8, 2023, in corresponding Chinese Application No. 202010544696.X (including English translation).

*Primary Examiner* — Jean F Duverne
(74) *Attorney, Agent, or Firm* — Harness, Dickey & Pierce, P.L.C.

(57) ABSTRACT

An electronic-cigarette cartridge and an electronic cigarette are provided. The electronic-cigarette cartridge includes: a first contact point and a second contact point which are connected to a base part of an electronic cigarette, wherein the first contact point is configured to connect a control signal, and the second contact point is configured to input a reference voltage signal; an authentication module, wherein one end of the authentication module is connected to the first contact point, another end is connected to the second contact point, and is configured to interact with the base part of the electronic cigarette to conduct anti-counterfeiting authentication; and a heating module which is connected in parallel with the authentication module and is configured to performing heating after the anti-counterfeiting authentication is passed; wherein a working frequency of the authentication module is at least 10 times that of the heating module.

12 Claims, 3 Drawing Sheets

(56) References Cited

U.S. PATENT DOCUMENTS

| | | | | |
|---|---|---|---|---|
| 2020/0000143 | A1* | 1/2020 | Anderson | G06F 21/44 |
| 2020/0029618 | A1 | 1/2020 | Fraser et al. | |
| 2020/0146353 | A1 | 5/2020 | Liu et al. | |
| 2021/0030070 | A1 | 2/2021 | Sun et al. | |
| 2021/0203328 | A1 | 7/2021 | Zhang et al. | |
| 2021/0401061 | A1* | 12/2021 | Davis | A24F 40/57 |

FOREIGN PATENT DOCUMENTS

| | | | |
|---|---|---|---|
| CA | 3020128 | A1 | 2/2020 |
| CN | 107437107 | A | 12/2017 |
| CN | 107493171 | A | 12/2017 |
| CN | 107708454 | A | 2/2018 |
| CN | 109086130 | A | 12/2018 |
| CN | 110558617 | A | 12/2019 |
| CN | 110876489 | A | 3/2020 |
| CN | 210299498 | U | 4/2020 |
| JP | 2003151752 | A | 5/2003 |

* cited by examiner

ELECTRONIC-CIGARETTE CARTRIDGE AND ELECTRONIC CIGARETTE

CROSS-REFERENCE TO RELATED APPLICATIONS

This application claims the benefit of priority to Chinese Patent Application No. 202010544696.X, filed on Jun. 15, 2020, and entitled "ELECTRONIC-CIGARETTE CARTRIDGE AND ELECTRONIC CIGARETTE", the entire disclosure of which is incorporated herein by reference.

TECHNICAL FIELD

The present disclosure generally relates to an electronic product technology field, and more particularly, to an electronic-cigarette cartridge and an electronic cigarette.

BACKGROUND

At present, an electronic cigarette usually includes two parts: a base part and a cartridge. The cartridge is configured to be assembled to the base part. The cigarette cartridge is a kind of consumable and needs to be continuously purchased.

Because quality of materials used in the cartridge may directly affect the health of a user, it is necessary to conduct anti-counterfeiting authentication for the cartridge to ensure that the cartridge purchased by the user is a qualified product after authentication.

In order to conduct anti-counterfeiting authentication of the cartridge, an authentication chip is installed in the cartridge, and correspondingly, a main control chip is installed in the base part. The anti-counterfeiting authentication of the cartridge is completed through interaction between the authentication chip and the main control chip.

However, the processing and manufacturing of electronic-cigarette cartridges with authentication chips are relatively complex in existing technology, and it is difficult to meet production requirements.

SUMMARY

Embodiments of the present disclosure may solve this problem: how to realize anti-counterfeiting authentication of an electronic-cigarette cartridge and ensure its performance with lower processing and manufacturing complexity.

In an embodiment of the present disclosure, an electronic-cigarette cartridge is provided, including: a first contact point and a second contact point which are connected to a base part of an electronic cigarette, wherein the first contact point is configured to connect a control signal, and the second contact point is configured to input a reference voltage signal; an authentication module, wherein one end of the authentication module is connected to the first contact point, another end is connected to the second contact point, and is configured to interact with the base part of the electronic cigarette to conduct anti-counterfeiting authentication of the electronic-cigarette cartridge; and a heating module which is connected in parallel with the authentication module and is configured to perform heating after the anti-counterfeiting authentication of the electronic-cigarette cartridge is passed; wherein a working frequency of the authentication module is high, a working frequency of the heating module is low, and the working frequency of the authentication module is at least 10 times that of the heating module, so that the authentication module and the heating module does not affect each other.

Optionally, the heating module includes an electronic heating device.

Optionally, the authentication module includes an authentication chip.

Optionally, the authentication module further includes: one or more inductive devices connected in series with the electronic heating device.

Optionally, the authentication module further includes a first capacitor, wherein the first capacitor is connected in parallel with the heating module and is configured to form parallel resonance with an inductive reactance of the heating module.

Optionally, the first capacitor is a built-in capacitor of the authentication chip.

In an embodiment of the present disclosure, an electronic cigarette is provided, including: any one of the electronic-cigarette cartridge described above; and a base part, configured to assemble the electronic-cigarette cartridge.

Optionally, the base part of the electronic cigarette includes a third contact point and a fourth contact point, wherein the third contact point is connected to a first contact point of the electronic-cigarette cartridge and is configured to output a control signal to the first contact point of the electronic-cigarette cartridge; and the fourth contact point is connected to a second contact point of the electronic-cigarette cartridge and is configured to output a reference voltage signal to the second contact point of the electronic-cigarette cartridge.

Optionally, the base part includes a third contact point, a fourth contact point, a main control module and a power supply voltage control module, wherein the power supply voltage control module is connected to a power supply output end and generates a control signal according to a voltage signal output by the power supply output end; the third contact point is connected with the first contact point of the electronic-cigarette cartridge, the main control module and the power supply voltage control module, and communicates the control signal to the first contact point of the electronic-cigarette cartridge; the fourth contact point is connected with the second contact point of the electronic-cigarette cartridge and the main control module, and outputs the reference voltage signal to the second contact point of the electronic-cigarette cartridge; and the main control module interacts with the authentication module to perform anti-counterfeiting authentication to the electronic-cigarette cartridge.

Optionally, the main control module includes a main control chip, a second capacitor and a third capacitor, wherein the main control chip includes a data transmitting end and a data receiving end; the second capacitor is connected to the data transmitting end of the main control chip; and the third capacitor is connected to the second capacitor and the data receiving end of the main control chip.

Optionally, the power supply voltage control module includes a first switch arranged between the power supply output end and the third contact point.

Optionally, the electronic-cigarette cartridge is detachably assembled at one end of the base part.

Embodiments of the present disclosure may have following advantages.

In embodiments of the present disclosure, the electronic-cigarette cartridge is connected to the base part of the electronic cigarette through the first contact point and the second contact point, namely there is no need to add contact points, which can avoid increasing processing and manufacturing complexity caused by increasing contact points, and ensure reliability of the electronic-cigarette cartridge. On the other hand, the authentication module works at a high frequency, the heating module works at a low frequency, and the working frequency of the authentication module is at least 10 times that of the heating module, so the authentication module and the heating module do not affect each other. Therefore, anti-counterfeiting authentication of the electronic-cigarette cartridge can be realized with low processing and manufacturing complexity, and performance of the electronic cigarette after the authentication is guaranteed.

DETAILED DESCRIPTION

In practice, if an electronic-cigarette cartridge does not need to conduct anti-counterfeiting authentication, it only needs to heat tobacco and smoke oil contained therein, so the only electronic device included in the electronic-cigarette cartridge is a resistance wire. A power signal and a ground signal are introduced from a base part of an electronic cigarette to the electronic-cigarette cartridge through two contact points between the electronic-cigarette cartridge and the base part, and frequency and time of conduction are controlled to heat the resistance wire.

In order to set an authentication chip in an electronic-cigarette cartridge and realize anti-counterfeiting authentication of the electronic-cigarette cartridge, the following two solutions are usually adopted.

Figure 1:
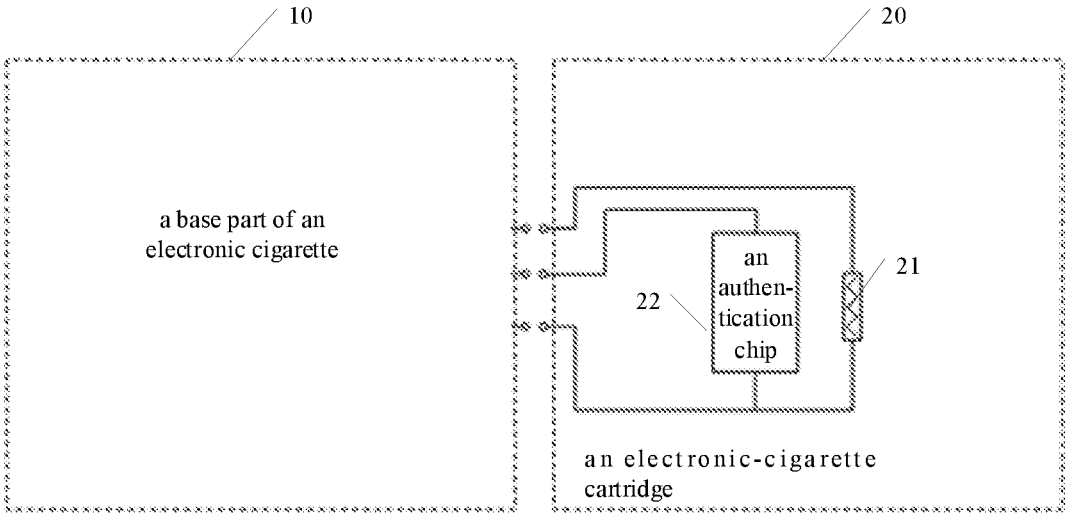
FIG. 1 schematically illustrate a structural diagram of an electronic cigarette in prior art.

First, referring to FIG. 1, one contact point is added to a base part 10 of an electronic cigarette and an electronic-cigarette cartridge 20 of the electronic cigarette, respectively, wherein each of the base part 10 and the electronic-cigarette cartridge 20 have two original contact points, that is, each of the base part 10 and the cartridge 20 have three contact points in total. After authentication is passed, heating of a resistance wire will be activated through the added contact points.

However, adding contact points will increase the complexity of processing and manufacturing and the difficulty of reliable contact.

Figure 2:
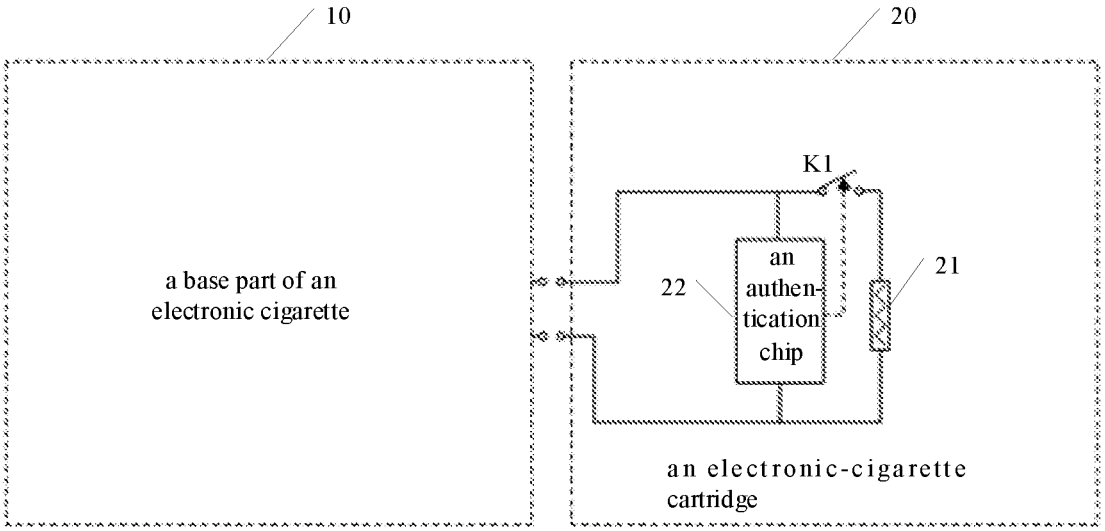
FIG. 2 schematically illustrate a structural diagram of an electronic cigarette in another prior art.

Second, referring to FIG. 2, each of a base part 10 and an electronic-cigarette cartridge 20 have two contact points. In order to prevent low impedance of a resistance wire 21 in the electronic-cigarette cartridge 20 from affecting an authentication chip 22, a switch K1 is added in the electronic-cigarette cartridge 20, and the resistance wire is controlled by the switch K1.

However, in the second solution, although the base part 10 and the electronic-cigarette cartridge 20 have two contact points respectively, a switch is added in the electronic-cigarette cartridge 20, which will also increase processing and manufacturing complexity.

In order to solve the problems described above, a base part of an electronic cigarette and an electronic-cigarette cartridge are kept to have two contact points each in embodiments of the present disclosure. An authentication module is configured to work at a high frequency and a heating module is configured to work at a low frequency, and a working frequency of the authentication module is at least 10 times that of the heating module, so that the authentication module and the heating module do not affect each other, which facilitates reducing processing and manufacturing complexity and ensures performance of the electronic cigarette.

In order to clarify the object, characteristic and advantages of embodiments of the present disclosure, embodiments of present disclosure will be described clearly in detail in conjunction with accompanying drawings.

Figure 3:
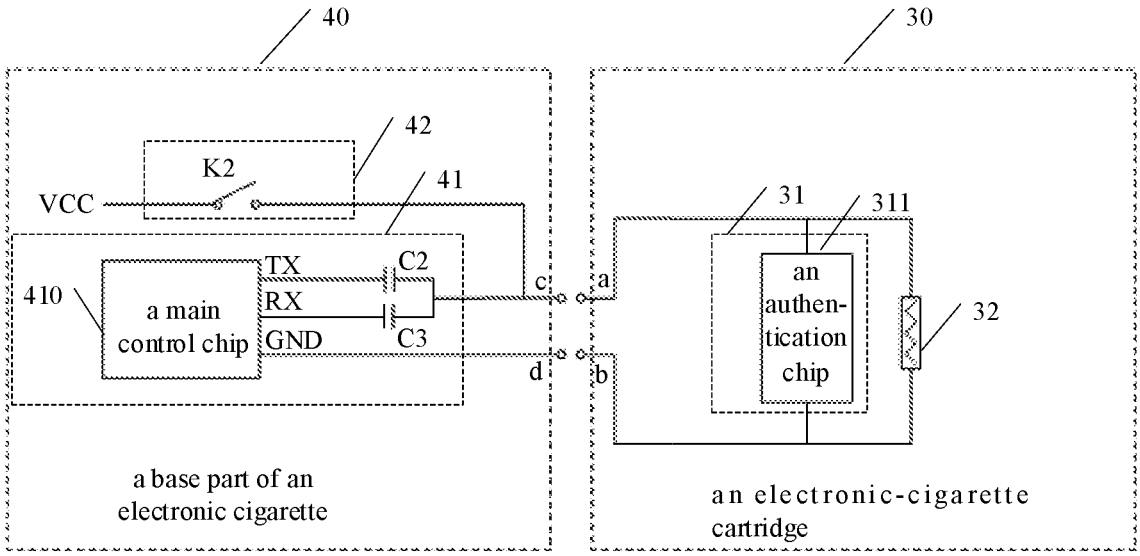
FIG. 3 schematically illustrate a structural diagram of an electronic cigarette according to an embodiment.

Referring to FIG. 3, in an embodiment of the present disclosure, an electronic-cigarette cartridge 30 is provided. The electronic-cigarette cartridge 30 includes: a first contact point a and a second contact point b which are configured to be connected to a base part of an electronic cigarette, wherein the first contact point a is configured to connect a control signal, and the second contact point b is configured to input a reference voltage signal.

The electronic-cigarette cartridge 30 may further include an authentication module 31 and a heating module 32. The authentication module 31 has one end connected to the first contact point a, another end connected to the second contact point b, and is configured to interact with the base part of the electronic cigarette to conduct anti-counterfeiting authentication of the electronic-cigarette cartridge 30. The heating module 32 is connected in parallel with the authentication module 32 and is configured to perform heating after the anti-counterfeiting authentication of the electronic-cigarette cartridge 30 is passed.

The authentication module 31 works at a high frequency and the heating module 32 works at a low frequency. A working frequency of the authentication module 31 is at least 10 times that of the heating module 32, so that the authentication module 31 and the heating module 32 do not affect each other.

Specifically, the working frequency of the authentication module 31 is relatively high, that is, the authentication module 31 is a high-frequency device. And the working frequency of the heating module 32 is relatively low, that is, the heating module 32 is a low-frequency device. In practice, the working frequency of the authentication module 31 and the working frequency of the heating module 32 may be set according to actual needs and will not be limited here, as long as the authentication module 31 and the heating module 32 will not affect each other.

For example, the working frequency of the authentication module 31 is 10 Mhz, and the working frequency of the heating module 32 is 200 hz.

Specifically, the control signal is used to control the heating module 32 to perform heating. The control signal may be a Pulse Width Modulation (PWM) signal output from a PWM signal output terminal, or it may be a PWM signal generated from a power supply output terminal, which will not be limited here.

Specifically, there is a voltage difference between the reference voltage signal and the control signal, which enables the heating module 32 to perform heating. For example, the reference voltage signal may be set as a ground signal.

Specifically, the authentication module 31 may be implemented in a variety of structures, which will not be limited here.

In some embodiments, the authentication module 31 may include an authentication chip 311, and the authentication chip 311 interacts with the base part of the electronic cigarette to complete the anti-counterfeiting authentication of the cartridge. In some embodiments, the authentication module 31 may include one or more authentication chips. When the authentication module 31 includes a plurality of authentication chips, the plurality of authentication chips cooperate to complete the anti-counterfeiting authentication of the electronic-cigarette cartridge.

Specifically, the heating module 32 may be implemented in a variety of structures, which is not limited here, as long as it can perform heating of smoke oil and tobacco.

In some embodiments, referring to FIG. 3, the heating module 32 may include an electronic heating device. Specifically, the electronic heating device may be a resistance wire which can perform heating of smoke oil and tobacco.

In practice, there are multiple ways to enable the authentication module 31 work at a high frequency and the heating module 32 work at a low frequency. For example, an authentication chip 311 which is suitable for working at a high frequency may be used as the authentication module 31, and a resistance wire which is suitable for working at a low frequency may be used as the heating module 32.

Since the impedance of an electronic heating device is smaller at a low frequency and becomes larger at a high frequency, the authentication module 31 is configured to work at a higher frequency, and the heating module 32 is configured to work at a lower frequency. In this way, the authentication module 31 can avoid working at a lower frequency of the heating module 32, and when the authentication module 31 is working, the impedance of the heating module 32 will be larger. Besides, the heating module will show inductive characteristics at a high frequency, in which case the authentication module 31 is connected in parallel with a large impedance and will not be affected by a low working voltage caused by the low resistance of the resistance wire. When the heating module 32 is working, the authentication module 31 does not work. Besides, the authentication module 31 has a large impedance, which will not have a great impact on a large operating current of the heating module 32 which is working at a low frequency. Therefore, according to embodiments of the present disclosure, not only there is no need to add contact points, but also the performance of the electronic-cigarette cartridge 30 is not affected.

Figure 4:
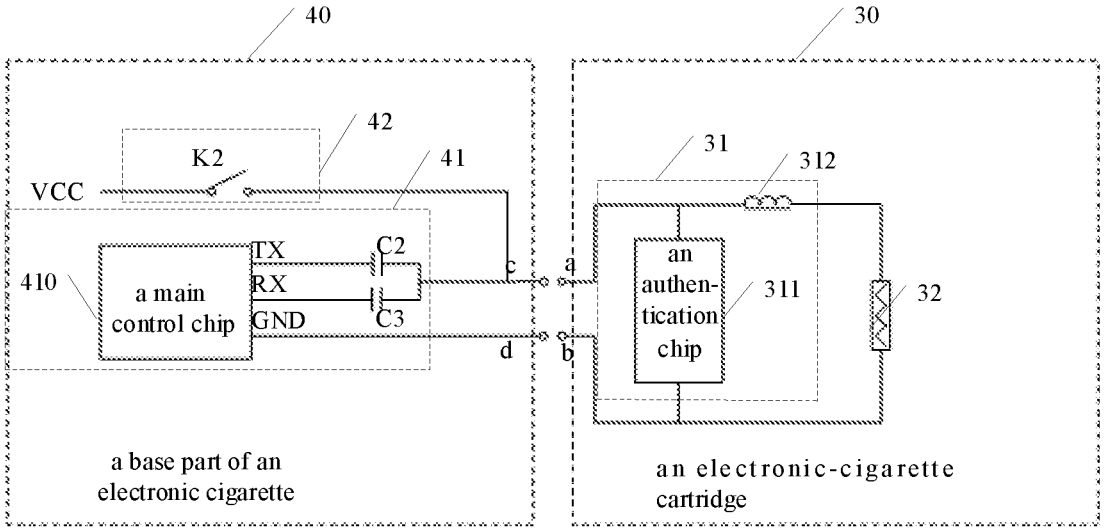
FIG. 4 schematically illustrate a structural diagram of an electronic cigarette according to another embodiment.

In an embodiment of the present disclosure, referring to FIG. 4, the authentication module 31 may further include at least one inductive device 312 connected in series with an electronic heating device. When the inductive device 312 is connected to an AC signal, a voltage at an end of the inductive device 312 which is connected to the authentication module 31 will increase because the current cannot change abruptly. Under the condition that a voltage at the other end of the authentication module 31 remains unchanged, the working voltage of the authentication module 31 will rise.

Specifically, a position and a number of the inductive device 312 connected in series with the electronic heating device can be configured according to the working voltage of the authentication module 31. The number of the inductive device 312 may be one, two or more than two.

Specifically, the inductive device 312 refers to a device with inductance characteristics of the current lagging the voltage, for example, an inductor, a wire wound with a coil, etc.

It can be understood that in order to ensure that the electronic heating device can be effectively heated after the authentication is passed, the inductive device should have a lower impedance when working at a low frequency, and can support a larger working current to prevent electrical energy from being wasted on heat while the electronic heating device is being heated.

Figure 5:
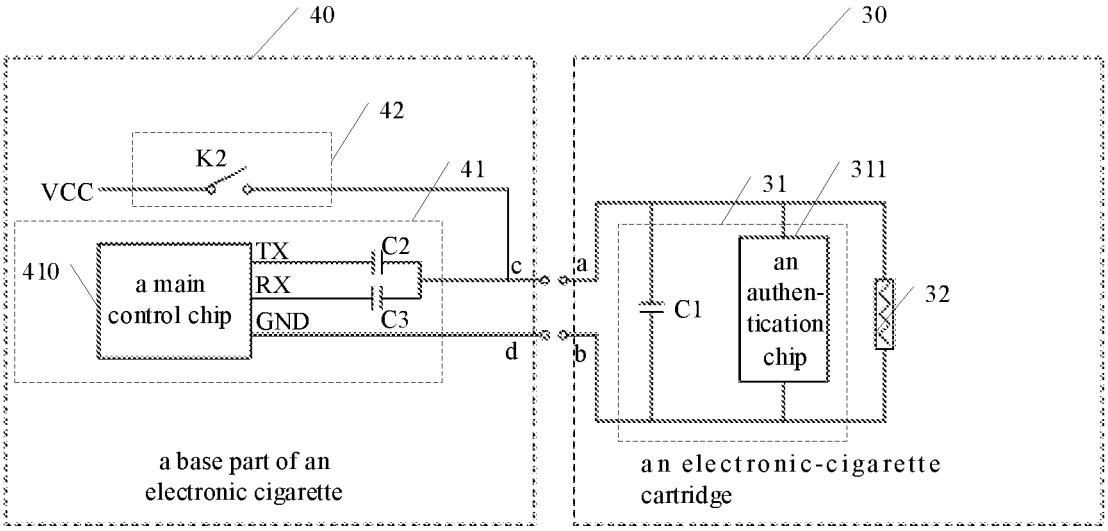
FIG. 5 schematically illustrate a structural diagram of an electronic cigarette according to another embodiment.

In an embodiment of the present disclosure, referring to FIG. 5, the authentication module 31 may further include a first capacitor C1 which is connected in parallel with the heating module 32.

In practice, an electronic heating device will show inductive reactance characteristics while working at a high frequency, and thus the electronic heating device will form a resonance circuit with the first capacitor C1, which will increase the working voltage of the authentication module 31.

Specifically, the capacitance of the first capacitor C1 may be set according to a working voltage required for the authentication module 31.

In some embodiments, the first capacitor C1 may be a built-in capacitor of the authentication chip 311, and the built-in capacitor is connected in parallel with the heating module 32. In this way, there is no need to configure the first capacitor C1 in the electronic-cigarette cartridge 30, and the working voltage of the authentication chip can also be improved.

It can be understood that the built-in capacitor is a capacitor between two pins of the authentication chip which are connected to the first contact point a and the second contact point b. The built-in capacitor can also form a resonance circuit with the electronic heating device to increase the working voltage of the authentication chip 311.

In summary, the electronic-cigarette cartridge 30 provided in embodiments of the present disclosure allows the authentication module 31 to work at a high frequency and the heating module 32 to work at a low frequency. Thus, functions of the electronic-cigarette cartridge 30 can be realized without adding contact points.

Referring to FIGS. 3 to 5, in an embodiment of the present disclosure, an electronic cigarette is provided. The electronic cigarette includes an electronic-cigarette cartridge 30 and a base part 40.

Specifically, the electronic-cigarette cartridge 30 has two contact points for external connection, namely a first contact point a and a second contact point b.

In some embodiments, the base part 40 has only two contact points for external connection, namely a third contact point c and a fourth contact point d, wherein the third contact point c is configured to connect the first contact point a, and the fourth contact point d is configured to connect the second contact point b.

Specifically, the third contact point c is configured to output a control signal, such as a PWM signal, through which the heating module 32 can be controlled to perform heating. Correspondingly, the fourth contact point d is configured to output a reference voltage signal, and there is a voltage difference between the reference voltage signal and the control signal output by the third contact point c.

In some embodiments, besides the third contact point c and the fourth contact point d, the base part 40 further includes a main control module 41 and a power supply voltage control module 42. Both the third contact point c and the fourth contact point d are connected to the main control module 41. The power supply voltage control module 42 is connected to a power supply output end and generates a control signal according to a voltage signal output by the power supply output end.

In some embodiments, the main control module 41 may include: a main control chip 410, a second capacitor C2 and a third capacitor C3.

Specifically, the main control chip 410 includes a data transmitting end TX, a data receiving end RX and a ground signal output end GND. The second capacitor C2 is connected to the data transmitting end TX of the main control chip 410, that is, the data transmitting end TX of the main control chip 410 is connected to the third contact point c through the second capacitor C2. The third capacitor C3 is connected to the second capacitor C2 and the data receiving end RX of the main control chip 410, that is, the data receiving end RX of the main control chip 410 is connected to the third contact point c through the third capacitor C3. The ground signal output end GND is connected to the second contact point b through the fourth contact point d.

In some embodiments, the power supply voltage control module 42 may include: a first switch K2 arranged between the power supply output end and the third contact point c. By controlling the first switch K2 to turn on or turn off, a power supply voltage VCC output from the power supply output end is controlled to convert into a PWM signal or not, and the PWM signal is applied to the heating module 32 of the electronic-cigarette cartridge 30.

Specifically, the main control chip 410 is connected to the power supply output end and is powered by the power supply voltage VCC output from the power supply output end. The two contact points c and d of the base part 40 respectively introduce the control signal and the reference voltage signal from the base part 40 to the electronic-cigarette cartridge 30.

When the first switch K2 is turned off, the heating module 32 is not working. After the main control chip 410 is powered on, it sends a high-frequency data signal to the authentication module 31 of the electronic-cigarette cartridge 30 through the data transmitting end TX. The main control chip 410 also receives a high-frequency data signal sent by the authentication module 31 of the electronic-cigarette cartridge 30 through the data receiving terminal RX. The main control chip 410 performs anti-counterfeiting authentication on the electronic-cigarette cartridge 30 by interacting with the authentication module 31 to confirm whether the electronic-cigarette cartridge 30 is a qualified product that has passed quality control. During the authentication process, the heating module 32 is working at a high frequency and the impedance thereof is large, so the voltage of the authentication module 31 will not be too low, and the authentication process will not be affected.

After the authentication is passed, the main control chip 410 stops interacting with the authentication module 31. Turn on the first switch K2. Because the power supply voltage VCC is a low-frequency signal, the authentication module 31 does not work at a low frequency, and the heating module 32 works at a low frequency, the heating function can be realized.

Specifically, the first switch K2 may be a triode, a MOS transistor, etc., which is not limited here.

Specifically, the electronic-cigarette cartridge 30 is detachably assembled at one end of the base part 40. Structures of the base part 40 and the electronic-cigarette cartridge 30 may vary, as long as they can match, which should not limit the protection scope of the present disclosure.

According to the embodiments of the present disclosure described above, the authentication process and the heating process of the electronic cigarette do not interfere with each other, and the electronic cigarette can be compatible with existing electronic cigarettes which are connected through two contacts. Furthermore, the processing and manufacturing complexity is reduced, which facilitates meeting production needs.

Although the present disclosure has been disclosed above with reference to preferred embodiments thereof, it should be understood that the disclosure is presented by way of example only, and not limitation. Those skilled in the art can modify and vary the embodiments without departing from the spirit and scope of the present disclosure.

What is claimed is:

1. An electronic-cigarette cartridge, comprising:

a first contact point and a second contact point which are connected to a base part of an electronic cigarette, wherein the first contact point is configured to connect a control signal, and the second contact point is configured to input a reference voltage signal;

an authentication module, wherein one end of the authentication module is connected to the first contact point, another end is connected to the second contact point, and is configured to interact with the base part of the electronic cigarette to conduct anti-counterfeiting authentication of the electronic-cigarette cartridge;

and a heating module which is connected in parallel with the authentication module and is configured to perform heating after the anti-counterfeiting authentication of the electronic-cigarette cartridge is passed;

wherein the authentication module works at a high frequency, the heating module works at a low frequency, and the working frequency of the authentication module is at least 10 times that of the heating module, so that the authentication module and the heating module do not affect each other.

2. The electronic-cigarette cartridge according to claim 1, wherein the heating module comprises an electronic heating device.

3. The electronic-cigarette cartridge according to claim 1, wherein the authentication module comprises an authentication chip.

4. The electronic-cigarette cartridge according to claim 3, wherein the authentication module further comprises: one or more inductive devices connected in series with the electronic heating device.

5. The electronic-cigarette cartridge according to claim 3, wherein the authentication module further comprises a first capacitor which is connected in parallel with the heating module, where the first capacitor is configured to form parallel resonance with an inductive reactance of the heating module.

6. The electronic-cigarette cartridge according to claim 5, wherein the first capacitor is a built-in capacitor of the authentication chip.

7. An electronic cigarette, comprising:

an electronic-cigarette cartridge according to claim 1; and a base part, configured to assemble the electronic-cigarette cartridge.

8. The electronic cigarette according to claim 7, wherein the base part comprises a third contact point and a fourth contact point, where the third contact point is connected to a first contact point of the electronic-cigarette cartridge and is configured to output a control signal to the first contact point of the electronic-cigarette cartridge; and the fourth contact point is connected to a second contact point of the electronic-cigarette cartridge and is configured to output a reference voltage signal to the second contact point of the electronic-cigarette cartridge.

9. The electronic cigarette according to claim 7, wherein the base part comprises a third contact point, a fourth contact point, a main control module and a power supply voltage control module, wherein the power supply voltage control module is connected to a power supply output end and generates a control signal according to a voltage signal output by the power supply output end;

the third contact point is connected with the first contact point of the electronic-cigarette cartridge, the main control module and the power supply voltage control module, and outputs the control signal to the first contact point of the electronic-cigarette cartridge;

the fourth contact point is connected with the second contact point of the electronic-cigarette cartridge and the main control module, and outputs the reference voltage signal to the second contact point of the electronic-cigarette cartridge; and the main control module interacts with the authentication module to perform anti-counterfeiting authentication to the electronic-cigarette cartridge.

10. The electronic cigarette according to claim 9, wherein the main control module comprises:

a main control chip comprising a data transmitting end and a data receiving end;

a second capacitor connected to the data transmitting end of the main control chip; and a third capacitor connected to the second capacitor and the data receiving end of the main control chip.

11. The electronic cigarette according to claim 9, wherein the power supply voltage control module comprises a first switch arranged between the power supply output end and the third contact point.

12. The electronic cigarette according to claim 7, wherein the electronic-cigarette cartridge is detachably assembled at one end of the base part.

* * * * *